US006611782B1

(12) United States Patent
Wooster et al.

(10) Patent No.: US 6,611,782 B1
(45) Date of Patent: Aug. 26, 2003

(54) REAL TIME BOXING SPORTS METER AND ASSOCIATED METHODS

(75) Inventors: Mark Wooster, Longmont, CO (US); Curtis A. Vock, Boulder, CO (US); Perry Youngs, Mattishall (GB); Adrian Larkin, Essex (GB)

(73) Assignee: PhatRat Technology, Inc., Niwot, CO (US)

( * ) Notice: Subject to any disclaimer, the term of this patent is extended or adjusted under 35 U.S.C. 154(b) by 0 days.

(21) Appl. No.: 09/698,659

(22) Filed: Oct. 27, 2000

Related U.S. Application Data

(60) Provisional application No. 60/161,846, filed on Oct. 27, 1999.

(51) Int. Cl.[7] ..... G01L 1/00

(52) U.S. Cl. ..... 702/149; 702/41; 702/139; 73/862.59; 482/84

(58) Field of Search ..... 702/139, 149, 702/41; 73/379.04, 862.59, 172; 482/84, 146; 600/567, 592

(56) References Cited

U.S. PATENT DOCUMENTS

| | | | | | |
|---|---|---|---|---|---|
| 4,824,107 | A | * | 4/1989 | French | 273/454 |
| 4,883,271 | A | * | 11/1989 | French | 273/454 |
| 5,258,927 | A | * | 11/1993 | Havriluk et al. | 702/149 |
| 5,471,405 | A | * | 11/1995 | Marsh | 702/41 |
| 5,723,786 | A | * | 3/1998 | Klapman | 73/379.04 |
| 5,984,842 | A | * | 11/1999 | Chu | 482/83 |
| 6,245,002 | B1 | * | 6/2001 | Beliakov | 482/148 |

* cited by examiner

*Primary Examiner*—Kamini Shah
(74) *Attorney, Agent, or Firm*—Curtis A. Vock; Lathrop & Gage LC

(57) ABSTRACT

A power sensing unit is incorporated into a boxing glove for use according to a method of quantifying impact forces in a boxing match in real time. Impact force data is transmitted from the boxing glove to a remote receiver. The force data is collated to assess the strike force generated by each boxer.

6 Claims, 1 Drawing Sheet

REAL TIME BOXING SPORTS METER AND ASSOCIATED METHODS

Related Applications

This application claims priority to provisional application No. 60/161,846 filed Oct. 27, 1999, and is incorporated herein by reference.

BACKGROUND

1. Field of The Invention

The invention relates to (a) a "power sensor" for boxing and to (b) an airtime and drop distance system for event locations.

2. Description of The Related Art

Useful background to the invention may be found in U.S. Pat. Nos. 5,960,380, 5,636,146 and 5,567,420, each of which is incorporated by reference to the same extent as though fully disclosed herein. These patents disclose various power sensors that can be used to measure force, either directly or indirectly, such as: (i) an accelerometer that senses a vibrational spectrum; a microphone assembly that senses a noise spectrum'; (iii) a switch that is responsive to a weight; (iv) a voltage-resistance sensor that generates a voltage indicative of speed; and (v) a plurality of accelerometers connected for evaluating speed. Other useful background can be found in PCT publication WO 98/54581, which is attached hereto as an appendix.

SUMMARY OF THE INVENTION

The invention of one aspect provides a quantitative boxing power meter to actively gauge the impact of blows on another boxer in real time. In. accord with the invention, a power sensing unit is incorporated into both boxing gloves of each boxer; and impact forces are wirelessly communicated to a judging station at the rink. The power sensing unit preferably includes at least one translational accelerometer arranged to detect force along the strike axis of the boxer. The acceleration data is monitored during the strike in the power sensing unit. In one aspect, the power or impact "force" is determined within the sensing unit and wirelessly communicated to the judging station. In another aspect, acceleration data is wirelessly communicated to the judging station; and software and a processor process the data to determine power or the impact force.

In another aspect, a method is provided for statistically monitoring boxer performance during each round and during cumulative rounds. Impact force measurements through the power sensing unit provide near real time information; and this data is processed in a remote computer to statistically quantify the boxing match.

In still another aspect, the power sensing unit has at least an additional translational accelerometer to detect forces transverse to the strike axis. Accelerations along this transverse axis provide additional information, according to the invention, including "mis strike" information (i.e., information that determines that the boxer's blow had significant sideways movement and this is detected) and imprecise hit information (i.e., information that the boxer's blow did not hit the ideal location of the opposing boxer).

In yet another aspect, the invention tracks blows struck per boxer during a round and/or cumulatively through all rounds. The invention further determines an average strike force per boxer for each round and/or through all rounds. The average strike force is determined in one aspect by dividing each strike by the forward peak acceleration (or deceleration) and by summing all such information during a round or cumulatively during the entire fight. This information can then be used in comparison between boxers to augment fight statistics.

In still another aspect, strike speed is determined, preferably at the time of impact on the opposing boxer. Peak speed may alternatively be determined. In one aspect, acceleration is integrated to determine the speed for a particular time interval. Since a boxer's arm moves sinusoidally, the invention of another aspect calibrates speed to the sinusoidal movement. For example, between each strike, there is a position that is approximately zero speed or where speed (or acceleration) direction changes. It is at this point that a calibration can be obtained to re-set the accelerometer.

DETAILED DESCRIPTION OF THE PREFERRED EMBODIMENTS

Figure 1:
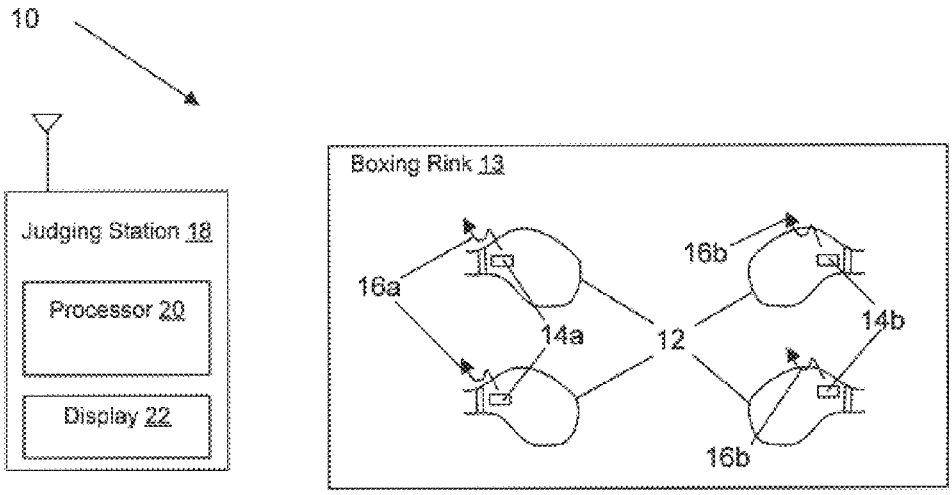
FIG. 1 is a schematic diagram depicting a system for use in quantifying strike characteristics and statistics during a boxing match.

FIG. 1 shows a system 10 constructed according to the invention for quantifying strike characteristics and statistics during a boxing match. Each boxing glove 12 (illustratively shown without a boxer within boxing rink 13) has a power sensing unit 14 disposed within the glove 12. Power sensing meter 14 wirelessly sends data 16 to judging station 18. Data 16 can be in the form of processed "impact force" data or substantially unprocessed acceleration data that is processed at the judging station 18 by processor 20 (e.g., a computer). Those skilled in the art should appreciate that data 16 can alternatively be transmitted to a base station for downloading on the Internet.

Each boxer thus has preferably has two units 14, the first boxer with units 14*a* which transmit data 16*a*; and the second boxer 14*b* transmitting data 16*b*. Data 16 is encoded to tell which boxer made the strike without confusion between the multiple data 16. A single sensor 14 might be used in one glove 12 in the alternative; however this is deemed not as exciting as informing the judge (and hence the audience) of all strikes by a boxer.

Figure 2:
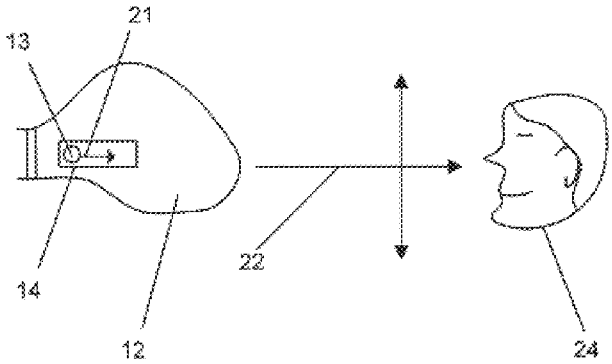
FIG. 2 is a schematic diagram depicting a power sensing unit for use in the system of FIG. 1.

Power sensing unit 14 has at least one sensor 13 (FIG. 2) disposed within unit 14 used to gauge impact force correlated to the force by which a boxer hits an opposing boxer. Preferably, the sensor is an accelerometer or a plurality of accelerometers. One accelerometer is preferably a translational accelerometer arranged with a sensitive axis 21 along the strike axis 22. FIG. 2 illustrates the strike axis 22 and mis-hit axes 25 in more detail. Specifically, a good strike along strike axis 22 onto opponent's face 24 indicates a high direct impact force; while a poor strike along axis 22 which produces a large force along axis 25 in addition, indicating that a substantial amount of power went into the mis-hit direction.

Data 16 is correlated and processed at processor 20 for display on display 22. Those skilled in the art should appreciate that processed data (e.g., how many hits and with what force did the first boxer do against the second) can also be provided to a judge or other users in other formats, e.g., on an LED, by print-out summary at the end of the match; or some other mechanism.

Processor 20 preferably stores processed data to determine statistics, e.g., how many strikes by boxer 1 as compared to boxer 2, the average strike power per boxer (per round or per match), and other useful metrics. In this embodiment, data 16 is time stamped and evaluated over time to make a statistical determination of each boxer's performance.

Figure 3:
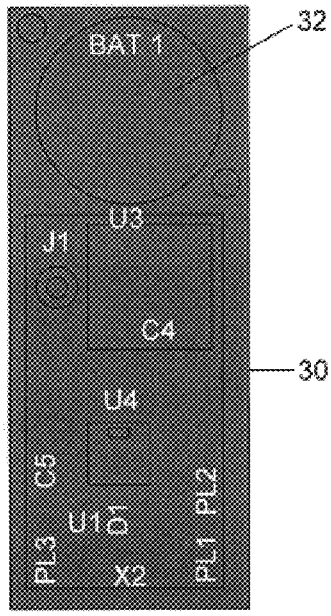
FIG. 3 provides additional detail with respect to the power sensing unit shown in FIG. 2.

FIG. 3 shows one power sensing unit 30 constructed according to the invention. Preferably, unit 30 is small to fit easily within the glove 12 and without obtrusion to the wearer. One acceptable size is, for example, ½" by 1" by 2 mm with a total weight of less than one ounce. Unit 30 has a round, highly dense battery 32 to power unit 30.

What is claimed is:

1. A method for quantifying impact forces in a boxing match in real time, comprising the steps of transmitting impact force data from each glove within the boxing match to a remote receiver, collating the force data to assess strike force generated by each boxer, and assessing statistics of the strike force data for each boxer, during a round or cumulatively during a match, to compare one boxer to another.

2. A method of claim 1, further comprising attaching or installing a power sensing unit with each glove.

3. A method of claim 1, wherein the step of transmitting comprises transmitting the data wirelessly to the remote receiver at a judging station.

4. A method of claim 1, further comprising the step of acquiring acceleration data along a hit axis of each glove, and wherein the step of transmitting impact force data comprises transmitting the acceleration data to the remote receiver.

5. A method of claim 1, further comprising acquiring rotational acceleration data indicative of mis-hit information.

6. A method of claim 1, further comprising acquiring a translational acceleration transverse to the hit axis to process and quantify mis-hit information.

* * * * *